US006866260B2

(12) United States Patent
Williams et al.

(10) Patent No.: US 6,866,260 B2
(45) Date of Patent: Mar. 15, 2005

(54) PRINTER SHEET LATERAL REGISTRATION AND DESKEWING SYSTEM

(75) Inventors: Lloyd A. Williams, Mahopac, NY (US); Joannes N. M. deJong, Hopewell Junction, NY (US); Matthew Dondiego, West Milford, NJ (US); Michael J. Savino, Tappan, NY (US)

(73) Assignee: Xerox Corporation, Stamford, CT (US)

( * ) Notice: Subject to any disclaimer, the term of this patent is extended or adjusted under 35 U.S.C. 154(b) by 217 days.

(21) Appl. No.: 10/369,811

(22) Filed: Feb. 19, 2003

(65) Prior Publication Data

US 2003/0146567 A1 Aug. 7, 2003

Related U.S. Application Data

(63) Continuation-in-part of application No. 09/916,993, filed on Jul. 27, 2001, now Pat. No. 6,533,268.

(51) Int. Cl.[7] ..... B65H 7/02
(52) U.S. Cl. ..... 271/227
(58) Field of Search ..... 271/227

(56) References Cited

U.S. PATENT DOCUMENTS 4,971,304 A 11/1990 Lofthus
5,094,442 A 3/1992 Kamprath et al.
5,278,624 A 1/1994 Kamprath et al.
6,533,268 B2 * 3/2003 Williams et al. ..... 271/228
6,575,458 B2 * 6/2003 Williams et al. ..... 271/228
2003/0020230 A1 * 1/2003 Williams et al. ..... 271/227
2003/0020231 A1 * 1/2003 Williams et al. ..... 271/227

FOREIGN PATENT DOCUMENTS

JP 63230451 * 9/1988 ..... B65H/9/16

* cited by examiner

*Primary Examiner*—Donald P. Walsh
*Assistant Examiner*—Kenneth W Bower

(57) ABSTRACT

A sheet registration system, especially for printers, with a lower cost and lower mass-movement system for both sheet deskewing and transverse registration repositioning of the sheets in the same integral system, especially for higher speed printing. Only one main drive motor can drive both of the two spaced apart sheet feeding nips, together with a lower power, lower mass, deskewing differential drive system for providing the relative differential angular movement of the two spaced sheet feeding nips to achieve the desired amount of sheet deskewing movement, without interrupting the forward feeding movement of the sheet. Also disclosed are extensive further reductions in the component mass of the lateral translation movement for lateral sheet registration.

20 Claims, 6 Drawing Sheets

PRINTER SHEET LATERAL REGISTRATION AND DESKEWING SYSTEM

This is a Continuation-in-Part of commonly owned and allowed U.S. application No. 09/916,993. filed Jul. 27, 2001. by Lloyd A. Williams et al, now U.S. Patent No. 6,533,268 issued Mar. 18, 2003 (Attorney Docket No. D/A1351Q) (PTO application publication date 1/30/03). which Is Incorporated by reference herein. It may be seen that in this CIP an additional embodiment of FIG. 6 has been added. Also, cross-referenced here are two other commonly-owned U.S. applications, No. 09/916,994. also filed Jul. 27, 2001 by Lloyd A. Williams et al, now U.S. Patent No. 6,575,458 issued Jun. 10, 2003 (Attorney Docket No. D/A1351) (PTO application publication date 1/30/03); and U.S. application No. 10/237,362, filed Sept. 6, 2002 by Douglas K. Herrmann (Attorney Docket No. D/Al 602).

Disclosed in the embodiments herein is an improved system for sheet lateral registration and sheet deskewing in the same combination apparatus. Various prior combined automatic sheet lateral registration and deskewing systems are known in the art. The below-cited patent disclosures are noted by way of some examples. They demonstrate the long-standing efforts in this technology for more effective yet lower cost sheet lateral registration and deskewing, particularly for printers (including, but not limited to, xerographic copiers and printers). They demonstrate that it has been known for some time to be desirable to have a sheet deskewing system that can be combined with a lateral sheet registration system, in a sheet driving system also maintaining the sheet forward speed and registration (for full three axis sheet position control) in the same apparatus. That is, it is desirable for both the sheet deskewing and lateral registration to be done while the sheets are kept moving along a paper path at a defined substantially constant speed. Otherwise known as sheet registration "on the fly" without sheet stoppages. Yet these prior systems have had some difficulties, which the novel systems disclosed herein address, further discussed below. In particular, high cost, especially for faster sheet feeding rates. However, it will be noted that the combined sheet handling systems disclosed herein are not limited to only high speed printing applications.

For faster printing rates, requiring faster sheet feeding rates along paper paths, which can reach more than, for example, 100—200 pages per minute, the above combined systems and functions become much more difficult and expensive. Especially, to accomplish the desired sheet skew rotation, sheet lateral movement, and forward sheet speed during the brief time period in which each sheet is in the sheet driving nips of the combined system. As further discussed below, such high speed sheet feeding for printing or other position-critical applications heretofore has commonly required, for the lateral sheet registration, variable rapid acceleration lateral (sideways to the sheet path) movements of relatively high mass system components, and substantial power for that rapid acceleration and rapid movement. Or, rapid "wiggling" of the sheet by deskewing, deliberately skewing, and again deskewing the sheet for side registration, all during that same brief time period the sheet is held in the sheet feeding nips of the system. Furthermore, in either such prior system, two high power servo-motors and their controls have typically been required for independently driving a laterally spaced pair of separate sheet driving nips, adding both expense and mass to the system.

Disclosed in the embodiments herein is an improved system for controlling, correcting or changing the orientation and position of sheets traveling in a sheet transport path. In particular, but not limited thereto, sheets being printed in a reproduction apparatus, which may include sheets being fed to be printed, sheets being recirculated for second side (duplex) printing, and/or sheets being outputted to a stacker, finisher or other output or module.

Disclosed in the embodiments herein is an improved system for deskewing and also transversely repositioning sheets with a lower cost, lower mass mechanism, and which for sheet feeding and deskewing needs only one single main drive motor for the two sheet feed roll drives, together with a much lower power, and lower cost, deskewing differential drive. This is in contrast to various of the below-cited and other systems which require three separate, large, high power, and separately controlled, servo or stepper motor drives. Yet the disclosed embodiments can provide in the same unit active automatic variable sheet deskewing and active variable side shifting for lateral registration, both while the sheet is moving uninterruptedly at process speed. It is applicable to various reproduction systems herein generally referred to as printers, including high-speed printers, and other sheet feeding applications. In particular the system of the disclosed embodiments can provide greatly reduced total moving mass, and therefor provide improvements in integral lateral registration systems involving rapid lateral movement thereof, such as the TELER type of lateral registration system described below.

Various types of lateral registration and deskew systems are known in the art. A recent example is Xerox Corp. U.S. Pat. No. 6,173,952 B1, issued Jan. 16, 2001 to Paul N. Richards, et al (and art cited therein) (D/99110). That patent's disclosed additional feature of variable lateral sheet feeding nip spacing, for better control over variable size sheets, may be readily combined with or into various applications of the present invention, if desired.

As noted, it is particularly desirable to be able to do lateral registration and deskew "on the fly," while the sheet is moving through or out of the reproduction system at normal process (sheet transport) speed. Also, to be able to do so with a system that does not substantially increase the overall sheet path length, or increase paper jam tendencies. The following additional patent disclosures, and other patents cited therein, are noted by way of some examples of sheet lateral registration systems with various means for side-shifting or laterally repositioning the sheet: Xerox Corporation U.S. Pat. Nos. 5,794,176, issued Aug. 11, 1998 to W. Milillo; 5,678,159, issued Oct. 14, 1997 to Lloyd A. Williams, et al; 4,971,304, issued Nov. 20, 1990 to Lofthus; 5,156,391, issued Oct. 20, 1992 to G. Roller; 5,078,384, issued Jan. 7, 1992 to S. Moore; 5,094,442, issued Mar. 10, 1992 to D. Kamprath, et al; 5,219,159, issued Jun. 15, 1993 to M. Malachowski, et al; 5,169,140, issued Dec. 8, 1992 to S. Wenthe; and 5,697,608, issued Dec. 16, 1997 to V. Castelli, et al. Also, IBM U.S. Pat. No. 4,511,242, issued Apr. 16, 1985 to Ashbee, et al.

Of particular interest here are the alternative differential sheet deskewing systems of D. Kamprath et al U.S. Pat. No. 5,278,624, issued Jan. 11, 1994 including that of it's FIG. 3. While said U.S. Pat. No. 5,278,624 does not itself disclose any lateral sheet side shifting system, it was recently noted that at its Col. 2 lines 58—61 it cites and incorporates by reference the above-cited U.S. Pat. No. 5,094,442, issued Mar. 10, 1992 to D. Kamprath, et al.

Various optical sheet lead edge and sheet side edge position detector sensors are known which may be utilized in such automatic sheet deskew and lateral registration systems. Various of these are disclosed the above-cited references and other references cited therein, or otherwise, such as the above-cited U.S. Pat. Nos. 5,678,159, issued Oct. 14, 1997 to Lloyd A. Williams, et al; and 5,697,608 to V. Castelli, et al.

Various of the above-cited and other patents show that it is well known to provide integral sheet deskewing and lateral registration systems in which a sheet is deskewed while moving through two laterally spaced apart sheet feed roller-idler nips, where the two separate sheet feed rollers are independently driven by two different respective drive motors. Temporarily driving the two motors at slightly different rotational speeds provides a slight difference in the total rotation or relative pitch position of each feed roller while the sheet is held in the two nips. That moves one side of the sheet ahead of the other to induce a skew (small partial rotation) in the sheet opposite from an initially detected sheet skew in the sheet as the sheet enters the deskewing system. Thereby deskewing the sheet so that the sheet is now oriented with (in line with) the paper path.

However, especially for high speed printing, sufficiently accurate continued process (downstream) sheet feeding requirements typically requires these two separate drive motors to be two relatively powerful and expensive servo-motors. Furthermore, although the two drive rollers are desirably axially aligned with one another to rotate in parallel planes and not induce sheet buckling or tearing by driving forward at different angles, the two drive rollers cannot both be fixed on the same common transverse drive shaft, since they must be independently driven.

For printing in general, the providing of both sheet skewing rotation and sheet side shifting while the sheet is being fed forward in the printer sheet path is a technical challenge, especially as the sheet path feeding speed increases. Print sheets are typically flimsy paper or plastic imageable substrates of varying thinnesses, stiffnesses, frictions, surface coatings, sizes, masses and humidity conditions. Various of such print sheets are particularly susceptible to feeder slippage, wrinkling, or tearing when subject to excessive accelerations, decelerations, drag forces, path bending, etc.

The above-cited Xerox Corp. U.S. Pat. No. 4,971,304, issued Nov. 20, 1990 to Lofthus (and various subsequent patents citing that patent, including the above-cited Xerox Corp. U.S. Pat. No. 6,173,952 B1, issued Jan. 16, 2001 to Paul N. Richards, et al) are of interest as showing that a two nips differentially driven sheet deskewing system, as described above, can also provide sheet lateral registration in the same unit and system, by differentially driving the two nips to provide full three axis sheet registration with the same two drive rollers and two drive motors, plus appropriate sensors and software. That type of deskewing system can provide sheet lateral registration by deskewing (differentially driving the two nips to remove any sensed initial sheet skew) and then deliberately inducing a fixed amount of sheet skew (rotation) with further differential driving, and driving the sheet forward while so skewed, thereby feeding the sheet sideways as well as forwardly, and then removing that induced skew after providing the desired amount of sheet side-shift providing the desired lateral registration position of the sheet edge. This Lofthus-type system of integral lateral registration does not require rapid side-shifting of the mass of the sheet feed nips and their drives, etc., for lateral registration. However, as noted, this Lofthus-type of lateral registration requires rapid plural rotations (high speed "wiggling") of the sheet. That has other challenges with increases in the speed of the sheet being both deskewed and side registered by plural differential rotations of the two nips, requiring additional controlled differential roll pair driving, especially for large or heavy sheets, and requires two separate large servo-motors for the two nips.

In contrast to the above-described Lofthus '304 type system of sheet lateral registration are sheet side-shifting systems in which the entire structure and mass of the carriage containing the two drive rollers, their opposing nip idlers, and the drive motors (unless splined drive telescopically connected), is axially side-shifted to side-shift the engaged sheet into lateral registration. In the latter systems the sheet lateral registration movement can be done during the same time as, but independently of, the sheet deskewing movement, thereby reducing the above-described sheet rotation requirements. These may be broadly. referred to as "TELER" systems, of, e.g., U.S. Pat. Nos. 5,094,442, issued Mar. 10, 1992 to Kamprath et al; 5,794,176 and 5,848,344 to Milillo, et al; 5,219,159, issued Jun. 15, 1993 to Malachowski and Kluger (citing numerous other patents); 5,337,133; and other above-cited patents.

For high speed sheet feeding, however, the rapid lateral acceleration and deceleration of a large mass in such prior TELER systems requires yet another (third) large drive motor to accomplish in the brief time period in which the sheet is still held in (but passing rapidly through) the pair of drive nips. That is, the entire deskew mechanism of two independently driven transversely spaced feed roll nips must move laterally by a variable distance each. time an incoming sheet is optically detected as needing lateral registration, by the amount of side-shift needed to bring that sheet into lateral registration. Also, an even more rapid opposite transverse return movement of the same large mass may be required in a prior TELER system to return the system back to its "home" or centered position before the (closely following) next sheet enters the two drive nips of the system. Especially if each sheet is entering the system laterally miss-registered in the same direction, as can easily occur, for example, if the input sheet stack side guides are not in accurate lateral alignment with the machines intended alignment path, which is typically determined by the image position of the image to be subsequently transferred to the sheets. Thus prior TELER type systems required a fairly costly operating mechanism and. drive system for integrating lateral registration into a deskew system.

To express this issue in other words, existing paper registration devices desirably register the paper in three degrees of freedom, i.e., process, lateral and skew. To do so in a single system or device, three independently controlled actuators are used in previous TELER type implementations in which the skew and process actuators are mounted on a carriage that is rapidly actuated laterally, requiring a relatively large additional motor. That is, the addition of lateral actuation requires the use of a laterally repositioning driven carriage, or a more complex coupling between lateral and skew systems must be provided. On the other hand, a Lofthus patent type system (as previously described) may require extra "wiggling" of the sheet by the drive nips to add and remove the induced skew, and that extra differential sheet driving (driving speed changes) can have increased drive slip potential.

In any of these systems, or the "SNIPS" system noted below, the use of sheet position sensors, such as a CCD multi-element linear strip array sensor, could be used in a feedback loop for slip compensation to insure the sheet achieving the desired three-axis registration. See, for example, the above-cited U.S. Pat. No. 5,678,159 to Lloyd A. Williams, et al.

Other art of lesser background interest on both deskewing and side registration, using a pivoting sheet feed nip, includes Xerox Corp. U.S. Pat. Nos. 4,919,318 and 4,936,527 issued to Lam Wong. However, as with some other art cited above, these Wong systems use fixed lateral sheet edge guides against which aside edges of all the sheets must rub as they move in the process direction, with potential wear problems. Also, they provide edge registration and cannot readily provide center registration in a sheet path of different size sheets.

Particularly noted as to a pivoting nips deskew and side registration system without such fixed edge guides, which can provide center registration, is the "SNIPS" system of both pivoting and rotating plural sheet feeding balls (with dual, different axis, drives per ball) of Xerox Corp. U.S. Pat. No. 6,059,284, issued May 9, 2000 to Barry M. Wolf, et al. However, the embodiments disclosed herein do not require such pivoting (dual axis) sheet engaging nips. That is, they do not require pivoting or rotation of sheet drive rollers or balls about an additional axis or rotation orthogonal to the normal concentric drive axis of rotation of the sheet drive rollers. Also, the disclosed embodiments allow the use of normal low slippage high friction feed rollers which may provide normal roller-width sheet line engagement of the sheet in the sheet feeding nips with an opposing idler roller, rather than ball drives with point contacts as in said U.S. Pat. No. 6,059,284.

As noted above, and as further described for example in the above-cited and other art, existing modern high speed xerographic printer paper registration devices typically use two spaced apart sheet drive nips to move the paper in the process direction, with the velocities of the two nips being independently driven and controlled by each having its own relatively expensive servo drive motor. Paper skew may thus be corrected by prescribing different velocities (V1, V2) for the two nips (nip 1 and nip 2) with the two servo-motors for a defined short period of time while the sheet is in the two nips. Typically, rotary encoders measure the driven angular velocity of both nips and a motor controller or controllers keeps this velocity at a prescribed target value V1 for nip 1 and V2 for nip 2. That velocity may be maintained the same until, and during, skew correction. The skew of the incoming paper is typically detected and determined from the difference in the time of arrival of the sheet lead edge at two laterally spaced sensors upstream of the two drive nips, multiplied by the known incoming sheet velocity. That measured paper skew may then be corrected by prescribing, with the motor controller(s), slightly different velocities (V1, V2) for the two nips for a short period of time while the sheet is in the nips. Although the power required for that small angular speed differential V1, V2 change (a slight acceleration and/or deceleration) for skew correction is small, both servo-motors must have sufficient power to continue to propel the paper in the forward direction at the proper process speed. That is, for this deskewing action, nip 1 and nip 2 are driven at different rotational velocities. However, the average forward velocity of the driven sheet of paper is 0.5 (V1+V2) and that forward velocity is desirably maintained substantially at the normal machine process (paper path) velocity. Two degrees of freedom (skew and forward velocity) are thus controlled with two independent and relatively large servo-motors driving the two spaced nips at different speeds in these prior systems.

Although drive systems illustrated in the examples herein are shown in a direct drive configuration, that is not required. For example, a timing belt or gear drive could be alternatively used, as in FIG. 6.

As noted above, providing the remaining lateral or third degree of sheet movement freedom and registration in present systems which desirably combine deskew and lateral registration typically require control by a third large servo-motor, as in the TELER type lateral registration systems described above, and relatively complex coupling mechanisms, for a further cost increase.

In any case, even in the above-described deskewing systems per se, since the two sheet driving and deskewing nips are completely independently driven, both drive motors therefor must have sufficient power and variable speed control to accurately propel the paper in the forward (process or downstream) sheet feeding direction at the desired process speed.

In contrast, the embodiments herein disclose a sheet deskewing system that needs only one (not two) such forward drive motor, for both nips, with sufficient power to propel the paper in the forward direction, and a second smaller and cheaper motor and differential system. That is, showing how to use only one drive to propel the paper in the forward direction and a second and much smaller and cheaper skew correction drive to correct for skew through a differential mechanism adjusting the rotational phase between the two nips without imposing any of the sheet driving load on that skew correction drive. This can provide a significant cost savings, as well as reduced mass and other improvements in lateral sheet registration.

In other words, especially in high productivity machines, where the sheet feeding forward velocity is substantial, that requirement has heretofore imposed the selection and use of at least two high performance motors/controllers for such sheet deskewing systems, at substantial cost. In contrast, the disclosed embodiments enable a single drive motor to positively drive both spaced apart sheet drive nips of the deskewing system yet enable a low cost actuator to provide similarly effective paper deskewing by providing a similar deskewing speed differential between those same two driven nips, thereby substantially reducing the overall cost of the deskewing system. More specifically, teaching herein how to use one motor for the power needed to move the paper in the forward (process) direction with both nips and a second and much smaller motor to correct for skew through a differential mechanism adjusting the phase between those two otherwise commonly driven drive nips.

A specific feature of the specific embodiments disclosed herein is to provide an integral sheet registration system for providing sheet forward feeding, sheet deskewing by partial sheet rotation, and sheet lateral registration by lateral sheet movement, with first and second spaced apart sheet feeding nips, wherein said first and second sheet feeding nips are both rotatably driven for said forward sheet feeding by a single and stationary nips drive motor, wherein said first and second sheet feeding nips are laterally repositionable for said sheet lateral registration by a lateral repositioning system, wherein said first and second sheet feeding nips are variably differentially rotatable with respect to one another by a differential drive system for said sheet deskewing, and wherein said differential drive system comprises a variably laterally translatable helical drive interconnection between said first and second sheet feeding nips to provide said variable differential rotation of said first and second sheet feeding nips with respect to one another and said rotatable driving of said first and second sheet feeding nips by said single and stationary nips drive motor.

Further specific features disclosed in the embodiments herein, individually or in combination, include those wherein said differential drive system for said sheet deskewing by partial sheet rotation comprises a differential drive motor providing said variable lateral translation of said helical drive interconnection between said first and second sheet feeding nips to provide said variable rotation between said first and second sheet feeding nips, and/or wherein said differential drive system variably laterally translatable helical drive interconnection between said first and second sheet feeding nips includes a variably laterally translatable meshing helical gear set drive of said second sheet feeding nip, and a differential drive motor providing said variable lateral translation of said meshing helical gear set, and wherein said variable lateral translation of said meshing gear set provides said variable differential rotation between said first and second sheet feeding nips, and/or wherein said differential drive system variably laterally translatable helical drive interconnection between said first and second sheet feeding nips comprises a laterally translatable regular gear drive of said first drive nip by said single and stationary nips drive motor, a laterally translatable helical gear drive of said second drive nip, and a shaft interconnection between said regular gear drive of said first sheet feeding nip and said helical gear drive of said second sheet feeding nip, and a differential drive motor providing variable translation of said shaft interconnection between said laterally translatable regular gear drive of said first sheet feeding nip and said laterally translatable helical gear drive of said second sheet feeding nip to provide said lateral translation of said helical gear drive of said second sheet feeding nip to provide said variable rotation between said first and second sheet feeding nips, and/or wherein said lateral repositioning system comprises a first laterally translatable shaft rotatably mounting spaced apart sheet drive rollers and a second and parallel and laterally translatable shaft rotatably mounting spaced apart idler rollers forming said first and second sheet feeding nips with said spaced apart drive rollers, said first and second laterally translatable shafts being connected together to laterally translate as a unit, and wherein said lateral repositioning system further includes a stationary lateral repositioning motor connected to provide said lateral translation of said first and second laterally translatable shafts as a unit to laterally translate said first and second sheet feeding nips for said sheet lateral registration, and/or wherein said differential drive system comprises a differentially variable helical gear interconnection between said first and second sheet feeding nips and a differential drive motor providing said differentially variations in said helical gear interconnection, and wherein said differential drive motor is laterally repositioned along with said first and second sheet feeding nips by said lateral repositioning system, and/or wherein said differential drive system includes a laterally translatable and rotatable tubular drive shaft connecting member extending laterally between the positions of said first and second sheet feeding nips, parallel thereto, and/or wherein said differential drive system includes a differential drive motor providing rotation of a lead screw providing said translation of said variably laterally translatable helical drive interconnection between said first and second sheet feeding nips to provide said variable differential rotation of said first and second sheet feeding nips, and/or wherein said integral sheet registration system is a component of a high speed printer, in the sheet path of said high speed printer, and said sheets are flimsy imageable print substrate sheets being automatically deskewed and laterally registered before they are printed, and/or wherein said wherein said differential drive system includes a differential drive motor and a laterally translatable and rotatable interconnect sleeve with a helical pin-riding slot laterally driven by said differential drive motor, and/or wherein said lateral repositioning system is driven by a single and stationary lateral drive motor, and wherein said lateral repositioning system and said differential drive system are both operable without interference with one another, and/or wherein said lateral repositioning system is driven by a single and stationary lateral drive motor, and wherein said differential drive system has a single differential drive motor which is laterally translatable with said lateral repositioning system and of much lower mass than said single and stationary nips drive motor, and wherein said variably laterally translatable helical drive interconnection between said first and second sheet feeding nips is variably laterally translated by said single and stationary lateral drive motor along with said single differential drive motor, and/or a method of sheet registration with an integral sheet registration system for providing sheet forward feeding, sheet deskewing by partial sheet rotation, and sheet lateral registration by lateral sheet movement, with first and second spaced apart sheet feeding nips, wherein said first and second sheet feeding nips are both rotatably driven for said forward sheet feeding by a single and stationary nips drive motor, wherein said first and second sheet feeding nips are laterally repositionable for said sheet lateral registration by a lateral repositioning system, wherein said first and second sheet feeding nips are variably differentially rotatable with respect to one another by a differential drive system for said sheet deskewing, and wherein said differential drive system comprises variable lateral translation of a helical drive interconnection between said first and second sheet feeding nips to provide said variable differential rotation of said first and second sheet feeding nips with respect to one another and said rotatable driving of said first and second sheet feeding nips by said single and stationary nips drive motor, and/or wherein said differential drive system variably laterally translatable helical drive interconnection between said first and second sheet feeding nips includes variable lateral translation of a meshing helical gear set drive of said second sheet feeding nip, wherein said variable lateral translation of said meshing helical gear set drive provides said variable rotation between said first and second sheet feeding nips, and/or wherein said lateral repositioning system comprises a first laterally translatable shaft rotatably mounting spaced apart sheet drive rollers and a second and parallel and laterally translatable shaft rotatably mounting spaced apart idler rollers forming said first and second sheet feeding nips with said spaced apart drive rollers, said first and second laterally translatable shafts being connected together to laterally translate as a unit, and wherein said lateral repositioning system further includes a stationary lateral repositioning motor providing said lateral translation of said first and second laterally translatable shafts as a unit to laterally translate said first and second sheet feeding nips for said sheet lateral registration, and/or wherein said differential drive system comprises a differentially variable helical gear interconnection between said first and second sheet feeding nips and a differential drive motor providing said differential variations in said helical gear interconnection, and wherein said differential drive motor is laterally repositioned along with said first and second sheet feeding nips by said lateral repositioning system, and/or wherein said lateral repositioning system is driven by a stationary lateral drive motor, and wherein said differential drive system has a single differential drive motor which is laterally translatable with said lateral repositioning system and of much lower mass than said single and stationary nips drive motor, and wherein said variably laterally translatable helical drive interconnection between said first and second sheet feeding nips is variably laterally translated by said stationary lateral drive motor along with said single differential drive motor, and/or wherein said lateral repositioning of both of said first and second spaced apart sheet feeding nips for said lateral sheet registration is provided without interruption of said positive rotational driving thereof and without interfering with said sheet deskewing, and/or wherein said differential drive system is driven by a differential motor of much lower power and size than said single and stationary nips drive motor, and/or wherein said differential drive system is automatically recentered when a sheet is not in said spaced apart sheet feeding nips.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present invention will be better understood from this description of these specific embodiments, including the drawing figures (which are approximately to scale) wherein:

Figure 1:
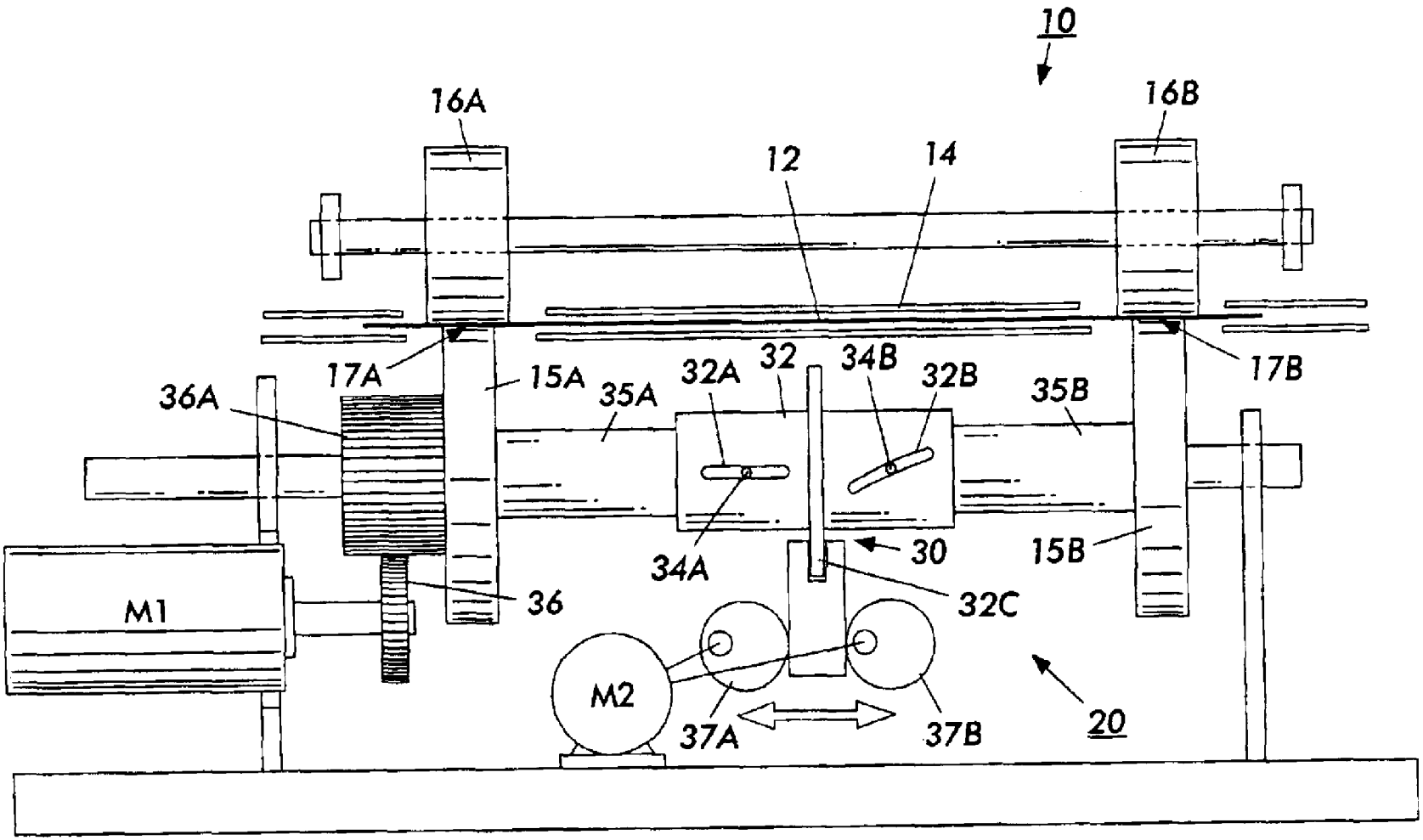
FIG. 1 is a partially schematic plan view, transversely of an exemplary printer paper path, of one embodiment from the parent application of a dual nip single drive motor automatic differential deskewing system which may be part of a combined deskewing and lateral registration system, as well as providing forward (downstream or process direction) sheet feeding movement and registration.
Figure 2:
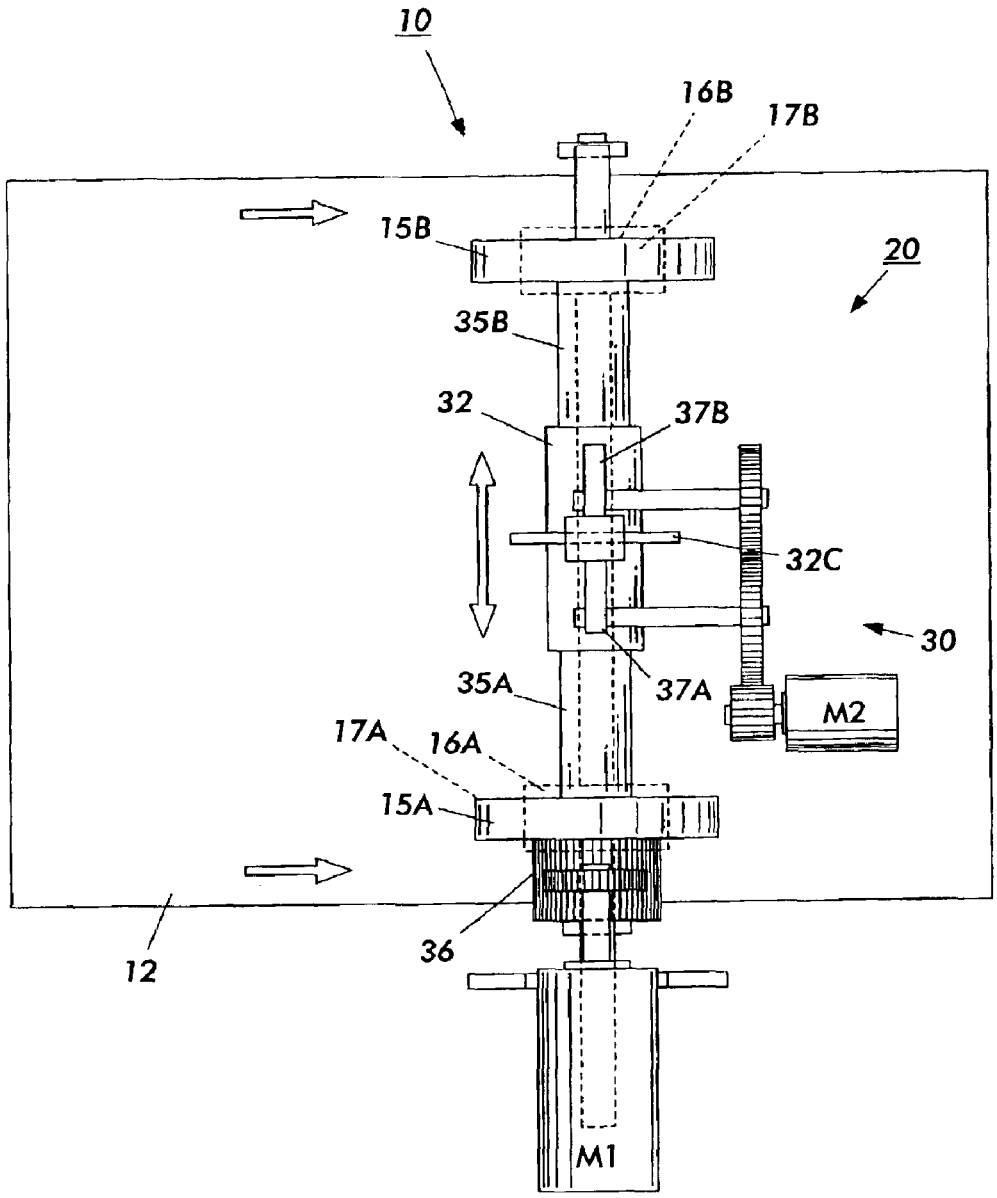
FIG. 2 is a bottom view of the embodiment of FIG. 1, with the sheet baffles removed for illustrative clarity.
Figure 3:
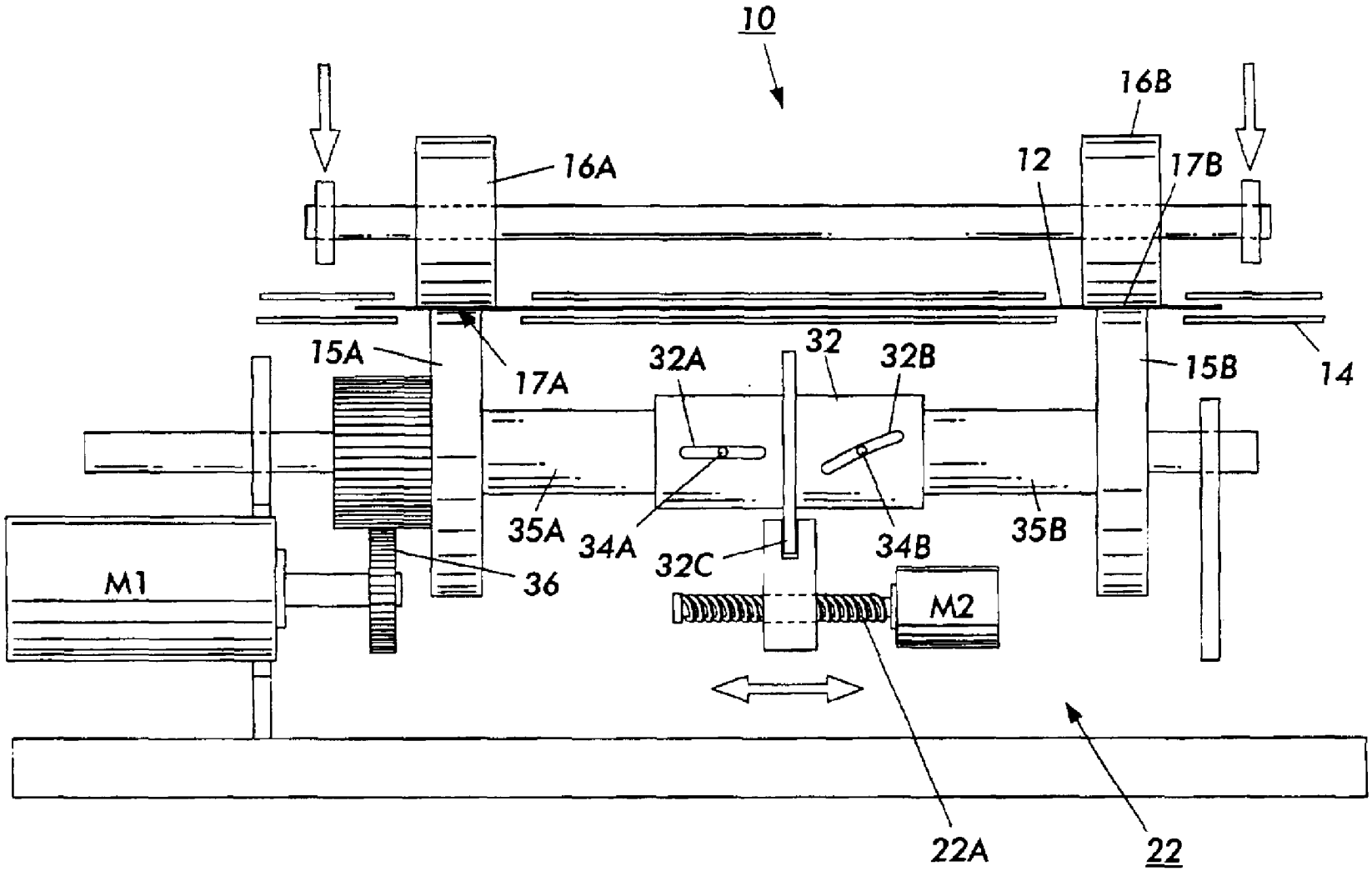
FIG. 3 is a plan view of second slightly different differential actuator embodiment version of the embodiment of FIGS. 1 and 2.
Figure 4:
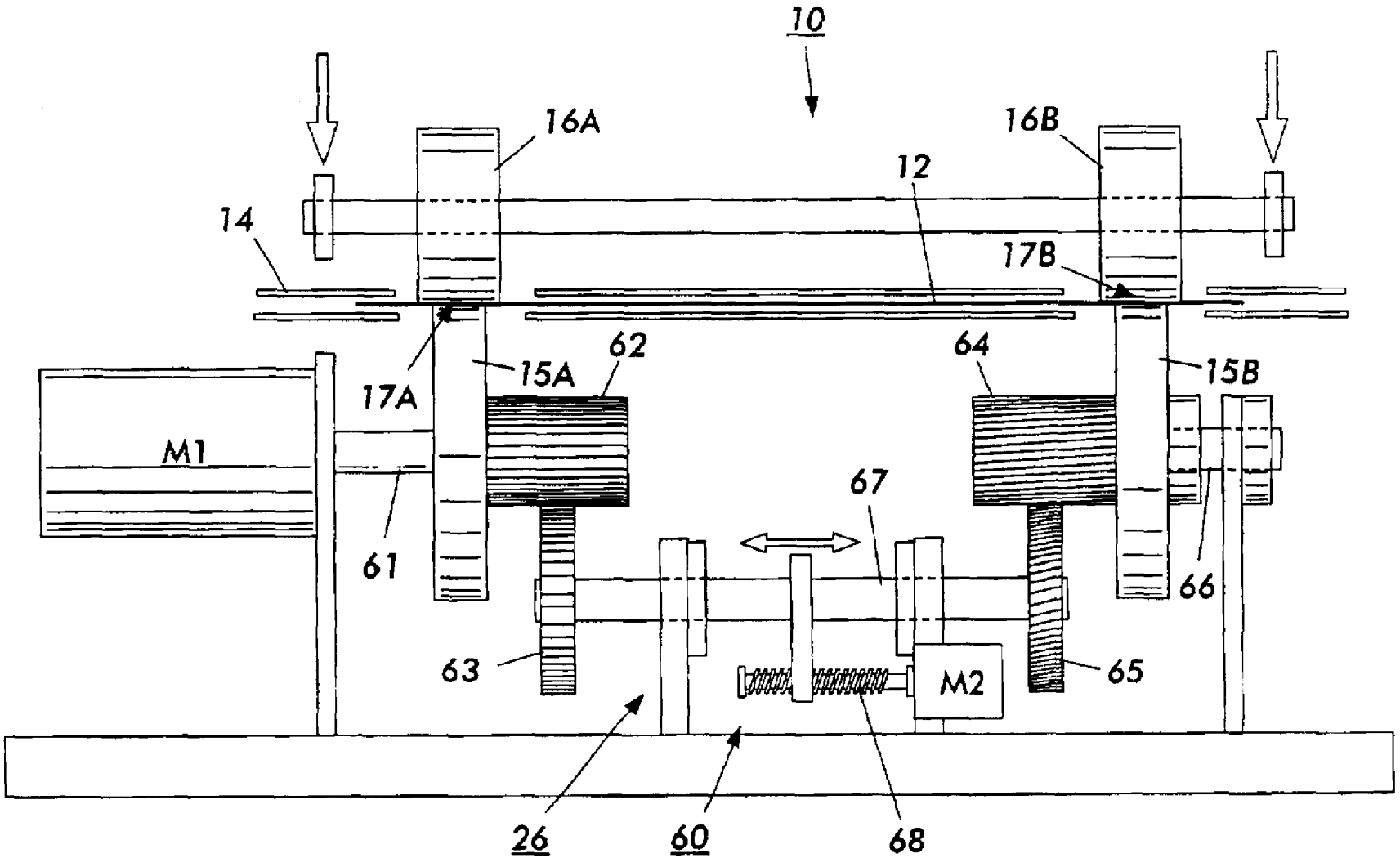
Figure 5:
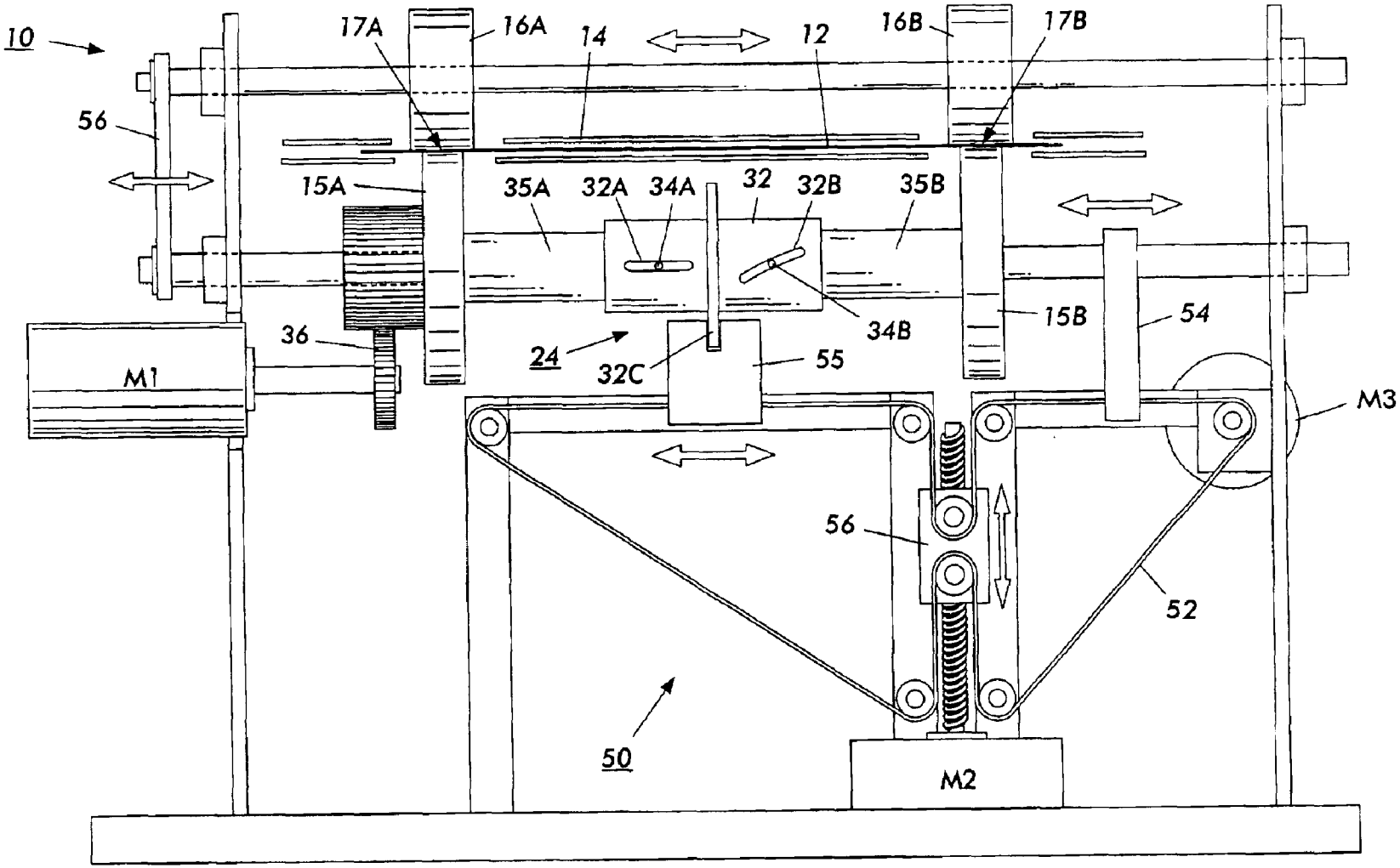
Figure 6:
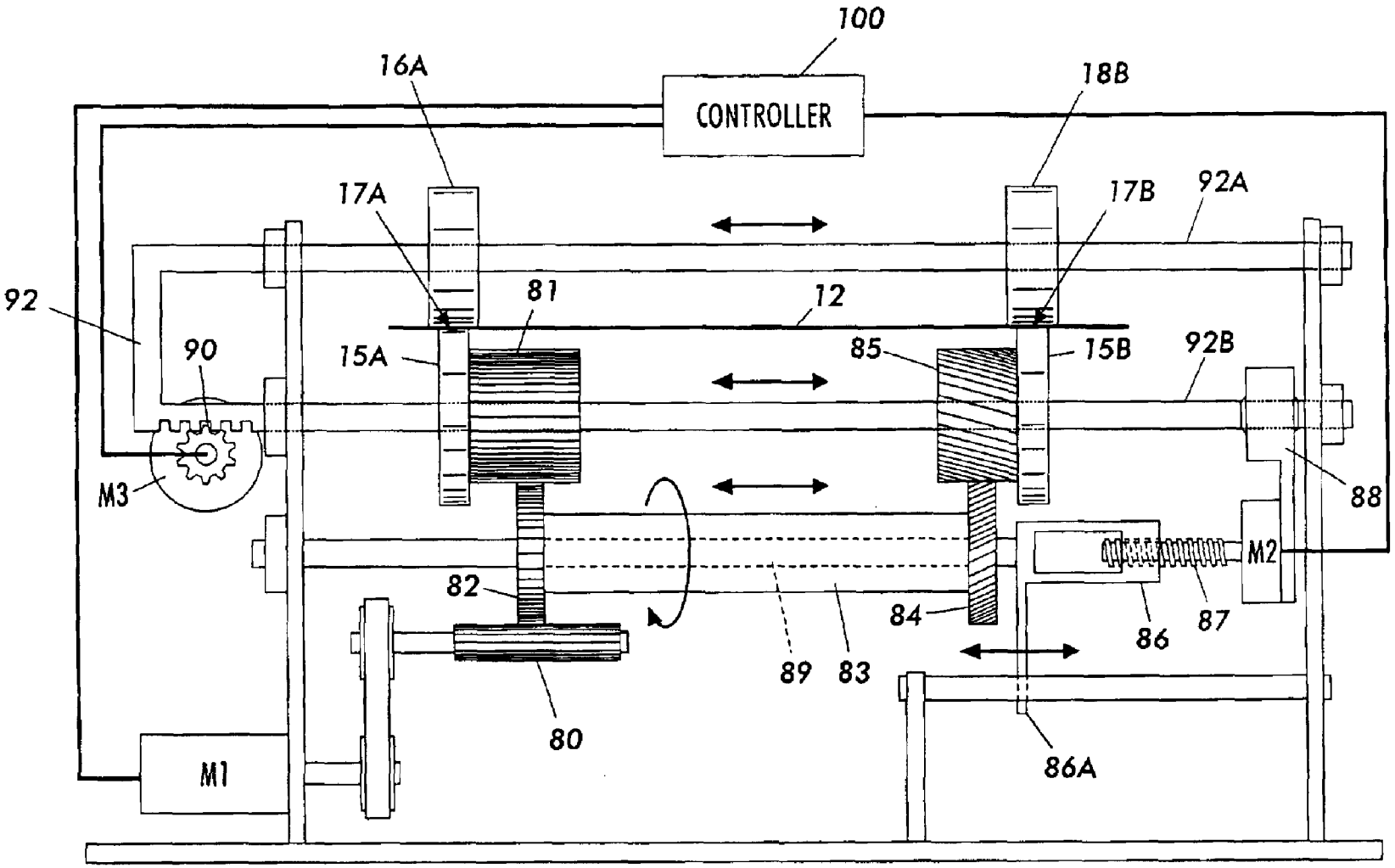

FIG. 4 (FIG. 5 in the parent application) is a plan view partially schematically illustrating a slightly different said deskewing system embodiment which may also be part of a combined deskewing and forward and lateral sheet registration system, with a slightly different differential system having a laterally translatable meshing helical gears interconnection (M2,68,67,65,64);

FIG. 5 (FIG. 6 in the parent application) is a plan view partially schematically illustrating an exemplary combination of a deskew system like that of the embodiment of FIGS. 1-3 with one example of an integral lateral registration system; and FIG. 6 is a partially schematic plan view (partially in cross-section for added clarity) illustrating an additional exemplary integral combination sheet forward movement registration, deskew, and lateral registration system.

Describing now in further detail these exemplary embodiments with reference to the Figures, it may be seen that FIGS. 1-5 are identical to those of the parent application, and are also retained here for their disclosures of alternative features therein.

As described above, sheet deskewing systems are typically installed in a selected location or locations of the paper path or paths of various printing machines, especially high speed xerographic reproduction machines, for rapidly deskewing the sequence of sheets 12, as discussed above and as taught by the above and other references. Hence, only a portion of exemplary baffles 14 partially defining an exemplary printer 10 paper path is illustrated here in FIGS. 1-5, and there is no need to disclose other conventional details of a xerographic or other printer. Also for clarity and convenience, some of the components (parts) are shown as the same in these illustrated embodiments, and several of those common components are given the same reference numbers for clarity. Specifically, the two laterally spaced sheet drive rollers 15A, 15B and their mating idler rollers 16A, 16B forming the first and second drive nips 17A, 17B, and the single servo or stepper motor M1 sheet drive which is positively driving both nips 17A, 17B. Also (as compared to motor M1) the smaller, lower cost, lower power, and lower mass differential actuator drive motor M2.

These various illustrated deskewing system embodiments, as previously described, normally drive the two drive nips 17A, 17B at substantially the same rotational speed to feed the sheet 12 in those nips downstream in the paper path at the desired forward process speed in the correct process registration position, except when the need for deskewing that sheet 12 is detected by the above-described and cited or other conventional optical sensors, which need not be shown here. That is, when the sheet 12 has arrived in the deskewing system in a. skewed condition needing deskewing. In that case, as further above-described and reference-cited, a corresponding pitch change by a small rotary positions driving difference between the two drive roller 15A, 15B, is made during the time the sheet 12 is passing through, and held in, the two sheet feeding nips 17A, 17B, to accomplish the desired deskew by a small partial sheet rotation. Yet, uniquely to all of these embodiments, only a single servo-motor Ml is needed to positively drive both drive rollers 15A, 15B even though their driving must so differ to provide said differential sheet rotation in the nips 17A, 17B for sheet deskew.

As taught by above-cited references, a combined sheet deskew and lateral registration system may be mounted on various lateral rails, rods or carriages so as to be laterally driven by any of various direct or indirect driving connections with another such servo or stepper motor providing lateral movement of the unit and therefore lateral movement of its nips.

Turning first to the new and improved embodiment of FIG. 6 herein, it may be seen that it's sheet deskew system has elements in common in particular with the FIG. 4 embodiment here (which was FIG. 5 in the parent application). The embodiment of FIG. 6 here also has some elements in common as to its lateral sheet registration system with the FIG. 6 embodiment of the parent application (which is FIG. 5 in this application).

While various different deskew systems can be combined with various different lateral sheet registration systems, the particular embodiment or species of FIG. 6 herein has particular additional advantages, especially for an integral high speed sheet deskew, forward, and lateral registration system, as will be apparent from the following description thereof.

As shown in FIG. 6, the single motor M1 providing both nip drives is driving a gear 80 via a timing belt. The elongated straight gear 80 drivingly engages a straight gear 82 which in turn drivingly engages a straight gear 81. The gear 81 is directly connected to the sheet drive roller 15A defining the first nip 17A. Both gear 81 and its connected sheet drive roller 15A are freely rotatably mounted on a mounting shaft 92B. The gear 82 is connected to and rotates an interconnecting hollow drive shaft 83, which rotates around a shaft 89 which can translate but does not need to rotate. The straight gears 80 and 81 have enough lateral (axial) teeth extension so that the gear 82 and its shafts 83 and 89 are able to move laterally relative to the gears 81 and 80 and still remain engaged.

At the other end of this same hollow drive shaft 83 (which is being indirectly but positively rotatably driven by the motor M1 via gears 80 and 82), there is mounted a helical gear 84, which thus rotates with the rotatable drive of the gear 82. This helical gear 84 drivingly engages another helical gear 85 which is fastened to the drive roller 15B of the second nip 17B to rotatably drive both of them (rotating on the shaft 92B). Thus, absent any axial movement of the shafts 83 and 89, the motor M1 is positively driving both of the sheet nips 17A and 17B with the same rotational speed and movement, to provide the same sheet 12 forward movement.

Like the member 32 in the embodiments of FIGS. 1-3 and 5, the hollow drive shaft 83 is providing a laterally translatable tubular drive connecting member between the two driven nips, which forms part of the differential drive deskewing system.

For deskewing, the desired amount of deskew is provided by slightly varying the angular position of the nip 17B relative to the nip 17A for a predetermined time period by a deskewing differential drive system. Here in FIG. 6 the particular differential drive system is powered by intermittent rotation of a deskew motor M2. This deskew motor M2 has low mass and low power as compared to the nip drives motor M1. The deskew motor M2 is fastened to the shaft 92B by a connector 88, and thus moves laterally therewith. When the deskew motor M2 is actuated by controller 100 it rotates its screw shaft 87. The screw shaft 87 engages with its screw threads a female nut 86, or other connector, such that rotation of the screw shaft 87 by the motor M2 moves the shaft 89 (and thus hollow shaft 83) axially towards or away from the motor M2, depending on the direction of rotation of its screw shaft 87. A relatively small such axial or lateral movement of the shaft 83 moves its two attached gears 82 and 84 laterally relative to the opposing shaft 92B on which is mounting the drive rollers 15A, 15B and their respective gears 81 and 85. The straight gear 82 can move laterally relative to its mating straight gear 81 without causing any relative rotation. However, in contrast, the translation of the mating helical gear connection between the gears 84 and 85 causes a rotational shift of the nip 17B relative to the nip 17A. That change (difference) in the nips rotational positions is in proportion to, and corresponds to, the amount of rotation of the screw shaft 87 by the deskew motor M2. This provides the desired sheet deskew. Reversal of the deskew motor M2 when a sheet is not in the nips 17A, 17B can then re-center the deskew system, if desired.

The female nut 86, as shown, provides spacing for substantial unobstructed lateral movement of the end of the screw shaft 87 therein as the screw shaft 87 rotates in the mating threads of the nut 86. The nut 86 also has an anti-rotation arm 86A, which, as illustrated can slideably engage a bar or other fixed frame member. Thus, the nut 86 does not need a rotary bearing to engage and move the non-rotating center shaft 89, and can be fastened thereto. Of course, alternatively, if desired, it could move the rotating outer tubular connecting shaft 83 laterally through a rotary bearing.

Turning now to the integral lateral sheet registration system also provided in the integral registration system of the embodiment of FIG. 7, as noted elsewhere herein, reducing as much as possible the mass of the components which must be laterally moved is very important for the sheet lateral registration system, especially for re-centering it rapidly between sheets. This is provided here by having only the relatively low mass components that need to move laterally for sheet lateral registration to be mounted on a unit 92 comprising parallel upper and lower arms or shafts 92A and 92B. In this particular FIG. 6 illustration this nips lateral translation unit 92 appears "U"-shaped or "trombone slide" shaped, but that is not essential. Although these two shafts 92A and 92B so shown, and fastened together on the left outside here, they could be fastened together elsewhere. These shafts 92A and 92B are non-rotating shafts that may be laterally slideably mounted through the frames of the overall sheet registration unit, as is one end of the parallel shaft 89.

The lateral (side-shifting) movement imparted to this unit 92 here is from a motor M3 driving the unit 92 via a rack and gear drive 90. The amount of lateral shifting here is thus controlled by the controller 100 controlling the amount of rotation of the motor M3. But the motor M3 itself is not part of the laterally moving mass, it is stationary and fixed to the machine frame.

The idlers 16A and 16B are freely rotatable on the upper arm or shaft 92A, but are mounted to move laterally when the unit 92 is so moved by the motor M3. Likewise, the gear 81 and its connecting drive roller 15A, and the gear 85 and its connecting drive roller 15B, are freely rotatable relative to the lower arm or shaft 92B, but mounted to move laterally when that arm or shaft 92B is moved laterally by the motor M3 gear drive 90. Since the upper and lower shafts 92A and 92B are parallel and are fastened together into a single slide unit 92, the drive rollers 15A, 15B will move laterally by same amount as the idlers 16A and 16B, to maintain, but laterally move, the two nips 17A, 17B. 15. As noted above, also attached to move laterally with the unit 92 is a coupling 88 mounting the deskew motor M2 to the lower arm 92B, so that the lateral sheet registration movement of the unit 92 also laterally moves the motor M2, its screw shaft 87, and thus the shaft 89, via its coupling 86.

Thus, it may be seen that the drive nips 17A and 17B and their deskew system can all be laterally shifted for lateral sheet registration without changing either the forward sheet speed and registration or the sheet deskewing positions while the lateral sheet registration is accomplished. That is, the deskewing operation controlled by the motor M2 is independent of the lateral registration movement provided by the motor M3. This allows all three registration movements of the sheet 12 to be desirably accomplished simultaneously, partially overlapping in time, or even separately. Yet neither the mass of the drive motor Ml or the mass of the lateral registration drive M3 need be moved for lateral sheet registration. Both may be fixed position motors.

Turning now to the deskewing system embodiment 20 of FIGS. 1 and 2, the following additional description will also apply to most of the similar second embodiment 22 of FIG. 3. Also, to the common deskewing system elements of the combined system of FIG. 5 (FIG. 6 of the parent application).

All three of those deskewing system embodiments provide said paper deskewing by said differential nip action through a simple and low cost differential mechanism system 30. Here, in this deskewing system embodiment 20 (and 22 of FIG. 3 and 24 of FIG. 6), that differential system 30 comprises a pin-riding helically slotted sleeve connector 32 which is laterally transposed by the small low cost differential motor M2. This particular example is a tubular sleeve connector 32 having two slots 32A, 32B, at least one of which is angular, partially annular or helical. These slots 32A, 32B respectively slideably contain the respective projecting pins 34A, 34B of the ends of the respective split co-axial drive shafts 35A, 35B over which the tubular sleeve connector 32 is slideably mounted. Each drive roller 15A, 15B is mounted to, for rotation with, a respective one of the drive shafts 35A, 35B, and one of those drive shafts, 34A here, is driven by the motor M1, here through the illustrated gear drive 36 although it could be directly. The two drive shafts 35A, 35B may themselves be tubular, to further reduce the system mass.

This variable pitch differential connection mechanism 30 enables a paper registration system that enables only one forward drive motor M1 to positively drive both nips 17A and 17B. Only the motor Ml needs to have the necessary power to propel the paper in the forward direction, while second much smaller, motor M2 does not need to drive the sheet forward, and only needs to provide enough power to operate the differential system 30 to correct for the sheet skew. That differential system 30 is small, accurate, inexpensive, and requires little power to operate. It may be actuated by any of numerous possible simple mechanisms simply providing a short linear movement. For example, in FIGS. 1 and 2 the motor M2 rotates opposing cams 37A, 37B by the desired amount to move the tubular sleeve 32 (as by engagement With its projecting flange or arm 32C), laterally to change by the angle of the slot 32B the relative angular positions of the two pins 34A, 34B, and thereby correspondingly change the relative angular positions of their two shafts 35A, 35B, and thereby differentially rotate one drive roller 15B relative to the other drive roller 15A to provide the desired deskewing of the sheet 12 by the difference between the two nips. Yet both rollers 15A and 15B otherwise continue to be driven, to drive the sheet 12 in the process direction at the same speed, by the same motor M1, because the sleeve 32 is positive drive connecting shaft 35A to shaft 35B by the pins 34A and 34B engaged in the slots 32A and 32B of the shared sleeve 32.

The alternative embodiment 22 of FIG. 3 differs only in showing an alternative drive of the differential deskewing mechanism, in which the motor M2 is controlled to selectively bi-directionally rotate a lead screw 22A which screw engages and moves the same flange or arm 32C of the sliding tubular sleeve 32 by a corresponding lateral distance.

To describe this helical slot deskewing device of FIGS. 1-5 in more detail, and in other words, the forward sheet drive motor Ml may be mounted to the base or frame of the system 20 or the printer 10. As shown, it may have a gear drive 36 with a pinion gear on the motor M1 shaft driving a drive gear on the first drive nip 17A assembly. That first drive nip assembly may consist of the drive shaft tube 35A, bearings, a drive gear, and the sheet drive wheel 15A mounted at one end, and a radially protruding pin at the other end of the shaft 35A. The opposing nip 17B assembly may be similar, but needs no drive gear. The opposing idlers 16A, 16B may be conventionally mounted on a dead shaft, with suitable spring normal force means if desired. If desired, the components may be vertically reversed, with the idlers mounted below the paper path and the two nip assemblies mounted above the paper path.

As noted, the helical slot differential drive tube or sleeve 32 is mounted to slide over (back and forth on) the inner ends of both drive tubes 35A, 35B. This drive tube 32 has slots 32A, 32B to accommodate the respective protruding radial pins 34A, 34B on the two opposing nip assemblies. The width of the slots 32A, 32B is only slightly greater than the diameter of the pins 34A, 34B. One slot, here 32A, may be straight, and be aligned parallel to the centerline of the drive tube 32. The other slot, 32B here, is fabricated with a slight helix at an acute angle to the centerline of the drive tube 32.

The pin 34A protruding from the shaft 35A of the first nip drive assembly transmits the torque generated by the motor M1 to the drive transmission tube 32 which then transmits that torque to the second nip drive assembly through the pin 34B. This enforces identical rotational velocities of the two nip drives. Yet, without interrupting that, the phase of the second nip assembly can be adjusted relative to the first nip assembly by simple axial movement of the helical slot drive tube 32. The helical slot 32B forces displacement of the radially mounted pin 34B, and thus the entire second nip assembly, in the tangential direction. This adjusts the relative phase of the first and second drive nips 17A, 17B and thus sets the skew imparted to the sheet 12 captured by those nips.

Periodically (after every sheet or after several sheets, or as necessary), the helical slot drive tube 32 may be re-centered to its home position, with the pins approximately centered in their slots, to prevent it from going to far to one side, or against its lateral end stops, which here are defined by the ends of the slots 32A, 32B. This should take place in between sheets, when no sheet 12 is in the nips.

Turning now to FIG. 5, this is one example of an integrated paper registration system 50 providing sheet lateral registration as well as skew correction, employing the same basic type of skew correction system 24 and its advantages as described above in connection with the systems 20 and 22 of FIGS. 1-3. The corresponding common component parts thereof are correspondingly numbered.

As previously described, the addition of lateral registration to the deskew system heretofore typically required the use of a carriage for lateral movement of the entire deskew system and its heavy dual servo-motors and/or a bothersome coupling between the lateral and skew systems. As further described above, prior TELER type systems registered the paper on all three axes (process, lateral and skew directions) by using three independently controlled large motors. In such TELER systems the two motor deskew and process direction sheet control system is mounted on a reciprocally moveable carriage that is actuated laterally for lateral sheet registration requiring a separate third large motor. In contrast, the deskew systems described above and below need only one motor to propel the paper in the forward direction and a much lighter second smaller motor and a relatively light differential transmission to correct for skew through a differential mechanism adjusting the phase between the two nips. This reduces the overall mass even if the entire mass of the entire deskew system is being laterally transposed for lateral registration. However, even further advantageous features of such combined deskew and lateral registration integral systems may be provided, as shown in FIGS. 5 and 6 and described here.

This integral three-axes sheet control system 50 of FIG. 6 decouples sheet lateral corrections and skew corrections without the need for a skew motor and/or process motors to travel with the lateral carriage. This allows here the skew system motor M2, the lateral drive motor M3, and the process or forward sheet feed motor M1 to all be mounted stationary on the base or frame. That makes the lateral carriage mass much lighter, allowing a smaller lateral actuator and/or a faster response time.

The addition of lateral actuation to the skew and process actuation requires movement of the nips and their shafts in the axial (transverse) direction. If the skew motor were fixedly mounted to the base and directly connected to the helical slot drive tube 32, the lateral movement of the system for lateral registration would introduce an unintended coupled relative displacement of the helical slot drive tube 32, resulting in skew error.

Referring to the exemplary FIG. 5 device for decoupling lateral and skew registration movements, one bight end of a single belt or cable 52 may be driven by the shaft of the lateral motion drive motor M3. This motor M3 may be mounted to the machine base or frame. The cable 52 is routed through a set of pulleys as shown in FIG. 5 and returns to the shaft pulley of the lateral motor M3. The shaft system used for lateral actuation is attached to the cable near the lateral motor M3 with a lateral clamp 54. A skew guide 55 which is engaging the helical slot drive tube 32 is also attached to a different section of the cable 52. The skew motor M2 here moves a skew carriage 56 that mounts two pulleys for two bights of the cable 52 through a lead screw drive. This skew motor M2 is mounted to the base, and does not need to laterally move. Although a lead screw actuation of the skew carriage 56 is depicted, cams or other actuation mechanisms could be used.

Operation of the lateral motor M3 moves the cable 52 to laterally move the shafts 35A and 35B in their frame slip bearings and by the lateral clamp 54 connection, but does not change the cable 52 length between the lateral clamp 54 and the skew guide 55. Hence, the relative position of the helical slot drive tube 32 with the pins 34A, 34B is maintained and skew is not affected by the lateral registration movement. The shaft of the idlers 16A, 16B is connected at 56 so that they also move laterally the same as the rollers 15A, 15B, so that the nips 17A and 17B move laterally. In effect, there is a U-shaped configuration of those shafts, including their interconnecting members 32 and 56, that can be moved laterally like a trombone tube by the motor M3.

For deskewing, actuation of the skew motor M2 moves the skew carriage 56 up or down and thereby changes cable 52 length between the lateral clamp 54 and the skew guide 55. This results in a relative movement of the helical slot drive tube 32, causing skew actuation as previously described, but without affecting the lateral nip position or sheet position.

It may also be seen in FIG. 5 that the main drive motor M1 may also be mounted to the frame and also does not need to be part of the laterally moved mass for lateral sheet registration. That is enabled by the width of the driven gear 36A in the gear drive 36, allowing it to move laterally with its shaft 35A relative to the driving gear without losing driving engagement. This it may be seen that in the system 50 that all of the three motors M1, M2 and M3 may be fixed and none need to move laterally, only the above described components. This greatly reduces the movement mass and required movement power for lateral sheet registration.

By all the motors being mounted to the frame of the machine, that also increases system rigidity and improves electrical connections. Furthermore, it may be seen that a moving carriage or frame is not required either. This further reduces the mass and the power requirements for the lateral motor and enables easier or faster acceleration and deceleration.

The additional different deskewing system embodiment 26 of FIG. 5 will now be described.

FIG. 5 shows a helical gear deskewing system 26. The forward drive motor M1 is mounted to the frame and drives a shaft 61 with drive roll 15A thereon. Both of them rotate at the same angular velocity as the sheet forward motor M1 here since this is a direct drive embodiment. That same shaft 61 has a gear 62 at the opposite end of that shaft, which mates with a skew system 60 differential drive gear 63. This first pair of mating gears 62, 63 may be straight (non-helical) gears, or vice versa. Here, the second set of mating gears 64, 65 is helical. That second set of gears 64, 65 is provided by the second drive roll 15B and its independently rotatable shaft 66 having the helical gear 64 (of a mating pair of helical gears) mounted onto that shaft 66 to rotate with drive roll 15B.

The second gear 65 of the set of helical gears and the second gear 63 of the set of straight gears are fixed on opposite ends of a skew shaft 67. This skew shaft 67 is mounted on bearings that allow axial displacement (note the movement arrow) by the skew motor actuator M2, here by a lead screw 68 drive.

Further describing the operation of this helical gear deskewing device 60 and deskewing system 26 of FIG. 5, if the axial displacement of the skew shaft 67 is kept constant, then the angular velocities of nip 17A and nip 17B will be identically driven by that connection and equal to the angular velocity of the motor M1. This will propel the sheet 12 in the forward direction. However, an axial displacement of the skew shaft 67 by the skew motor M2 will change the relative angular position of nip 17A and nip 17B, thus imparting a skew correction to the sheet 12.

Note that the skew correction may have a predictable associated forward displacement, which may be corrected by a slight change in the forward motor M1 drive speed. Periodically (every sheet, every few sheets, or whenever necessary), the skew shaft 67 may be centered back to its home position to prevent it from going against its end stops by further operation of motor M2, when no sheet is in the nips. The forward motor M1 must be of reasonable size, this size being determined by the paper velocity and opposing torques (sheet 12 drag in the upstream and downstream sheet 14 baffles, etc.). The skew motor M2 can be a small size, inexpensive, motor, since it's torque and speed requirements are small.

Various of the above-disclosed and other versions of the subject improved sheet deskewing system may be desirably combined into other lateral registration systems to provide various other improved integral sheet deskew and lateral registration systems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An integral sheet registration system for providing sheet forward feeding, sheet deskewing by partial sheet rotation, and sheet lateral registration by lateral sheet movement, with first and second spaced apart sheet feeding nips;

wherein said first and second sheet feeding nips are both rotatably driven for said forward sheet feeding by a single and stationary nips drive motor, wherein said first and second sheet feeding nips are laterally repositionable for said sheet lateral registration by a lateral repositioning system, wherein said first and second sheet feeding nips are variably differentially rotatable with respect to one another by a differential drive system for said sheet deskewing, and wherein said differential drive system comprises a variably laterally translatable helical drive interconnection between said first and second sheet feeding nips to provide said variable differential rotation of said first and second sheet feeding nips with respect to one another and said rotatable driving of said first and second sheet feeding nips by said single and stationary nips drive motor.

2. The integral sheet registration system of claim 1, wherein said differential drive system for said sheet deskewing by partial sheet rotation comprises a differential drive motor providing said variable lateral translation of said helical drive interconnection between said first and second sheet feeding nips to provide said. variable rotation between said first and second sheet feeding nips.

3. The integral sheet registration system of claim 1, wherein said differential drive system variably laterally translatable helical drive interconnection between said first and second sheet feeding nips includes a variably laterally translatable meshing helical gear set drive of said second sheet feeding nip, and a differential drive motor providing said variable lateral translation of said meshing helical gear set, and wherein said variable lateral translation of said meshing gear set provides said variable differential rotation between said first and second sheet feeding nips.

4. The integral sheet registration system of claim 1, wherein said differential drive system variably laterally translatable helical drive interconnection between said first and second sheet feeding nips comprises a laterally translatable regular gear drive of said first drive nip by said single and stationary nips drive motor, a laterally translatable helical gear drive of said second drive nip, and a shaft interconnection between said regular gear drive of said first sheet feeding nip and said helical gear drive of said second sheet feeding nip, and a differential drive motor providing variable translation of said shaft interconnection between said laterally translatable regular gear drive of said first sheet feeding nip and said laterally translatable helical gear drive of said second sheet feeding nip to provide said lateral translation of said helical gear drive of said second sheet feeding nip to provide said variable rotation between said first and second sheet feeding nips.

5. The integral sheet registration system of claim 1, wherein said lateral repositioning system comprises a first laterally translatable shaft rotatably mounting spaced apart sheet drive rollers and a second and parallel and laterally translatable shaft rotatably mounting spaced apart idler rollers forming said first and second sheet feeding nips with said spaced apart drive rollers, said first and second laterally translatable shafts being connected together to laterally translate as a Unit, and wherein said lateral repositioning system further includes a stationary lateral repositioning motor connected to provide said lateral translation of said first and second laterally translatable shafts as a unit to laterally translate said first and second sheet feeding nips for said sheet lateral registration.

6. The integral sheet registration system of claim 1, wherein said differential drive system comprises a differentially variable helical gear interconnection between said first and second sheet feeding nips and a differential drive motor providing said differentially variations in said helical gear interconnection, and wherein said differential drive motor is laterally repositioned along with said first and second sheet feeding nips by said lateral repositioning system.

7. The integral sheet registration system of claim 1, wherein said differential drive system includes a laterally translatable and rotatable tubular drive shaft connecting member extending laterally between the positions of said first and second sheet feeding nips, parallel thereto.

8. The integral sheet registration system of claim 1, wherein said differential drive system includes a differential drive motor providing rotation of a lead screw providing said translation of said variably laterally translatable helical drive interconnection between said first and second sheet feeding nips to provide said variable differential rotation of said first and second sheet feeding nips.

9. The integral sheet registration system of claim 1, wherein said integral sheet registration system is a component of a high speed printer, in the sheet path of said high speed printer, and said sheets are flimsy imageable print substrate sheets being automatically deskewed and laterally registered before they are printed.

10. The integral sheet registration system of claim 1, wherein said wherein said differential drive system includes a differential drive motor and a laterally translatable and rotatable interconnect sleeve with a helical pin-riding slot laterally driven by said differential drive motor.

11. The integral sheet registration system of claim 1, wherein said lateral repositioning system is driven by a single and stationary lateral drive motor, and wherein said lateral repositioning system and said differential drive system are both operable without interference with one another.

12. The integral sheet registration system of claim 1, wherein said lateral repositioning system is driven by a single and stationary lateral drive motor, and wherein said differential drive system has a single differential drive motor which is laterally translatable with said lateral repositioning system and of much lower mass than said single and stationary nips drive motor, and wherein said variably laterally translatable helical drive interconnection between said first and second sheet feeding nips is variably laterally translated by said single and stationary lateral drive motor along with said single differential drive motor.

13. A method of sheet registration with an integral sheet registration system for providing sheet forward feeding, sheet deskewing by partial sheet rotation, and sheet lateral registration by lateral sheet movement, with first and second spaced apart sheet feeding nips;

wherein said first and second sheet feeding nips are both rotatably driven for said forward sheet feeding by a single and stationary nips drive motor, wherein said first and second sheet feeding nips are laterally repositionable for said sheet lateral registration by a lateral repositioning system, wherein said first and second sheet feeding nips are variably differentially rotatable with respect to one another by a differential drive system for said sheet deskewing, and wherein said differential drive system comprises variable lateral translation of a helical drive interconnection between said first and second sheet feeding nips to provide said variable differential rotation of said first and second sheet feeding nips with respect to one another and said rotatable driving of said first and second sheet feeding nips by said single and stationary nips drive motor.

14. The method of sheet registration of claim 13, wherein said differential drive system variably laterally translatable helical drive interconnection between said first and second sheet feeding nips includes variable lateral translation of a meshing helical gear set drive of said second sheet feeding nip, wherein said variable lateral translation of said meshing helical gear set drive provides said variable rotation between said first and second sheet feeding nips.

15. The method of sheet registration of claim 13, wherein said lateral repositioning system comprises a first laterally translatable shaft rotatably mounting spaced apart sheet drive rollers and a second and parallel and laterally translatable shaft rotatably mounting spaced apart idler rollers forming said first and second sheet feeding nips with said spaced apart drive rollers, said first and second laterally translatable shafts being connected together to laterally translate as a unit, and wherein said lateral repositioning system further includes a stationary lateral repositioning motor providing said lateral translation of said first and second laterally translatable shafts as a unit to laterally translate said first and second sheet feeding nips for said sheet lateral registration.

16. The method of sheet registration of claim 13, wherein said differential drive system comprises a differentially variable helical gear interconnection between said first and second sheet feeding nips and a differential drive motor providing said differential variations in said helical gear interconnection, and wherein said differential drive motor is laterally repositioned along with said first and second sheet feeding nips by said lateral repositioning system.

17. The method of sheet registration of claim 13, wherein said lateral repositioning system is driven by a stationary lateral drive motor, and wherein said differential drive system has a single differential drive motor which is laterally translatable with said lateral repositioning system and of much lower mass than said single and stationary nips drive motor, and wherein said variably laterally translatable helical drive interconnection between said first and second sheet feeding nips is variably laterally translated by said stationary lateral drive motor along with said single differential drive motor.

18. The method of sheet registration of claim 13, wherein said lateral repositioning of both of said first and second spaced apart sheet feeding nips for said lateral sheet registration is provided without interruption of said positive rotational driving thereof and without interfering with said sheet deskewing.

19. The method of sheet registration of claim 13, wherein said differential drive system is driven by a differential motor of much lower power and size than said single and stationary nips drive motor.

20. The method of sheet registration of claim 13, wherein said differential drive system is automatically recentered when a sheet is not in said spaced apart sheet feeding nips.

* * * * *